US008529304B2

(12) United States Patent
Langhoff et al.

(10) Patent No.: US 8,529,304 B2
(45) Date of Patent: Sep. 10, 2013

(54) FEMALE ELECTRICAL CONTACT SYSTEM WITH A CONTACT SLEEVE WELDED TO A CONTACT COVER

(75) Inventors: Wolfgang Langhoff, Leonberg (DE); Michael Knödler, Stuttgart (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 13/390,088

(22) PCT Filed: Jul. 31, 2010

(86) PCT No.: PCT/EP2010/004692
§ 371 (c)(1),
(2), (4) Date: Feb. 10, 2012

(87) PCT Pub. No.: WO2011/020549
PCT Pub. Date: Feb. 24, 2011

(65) Prior Publication Data

US 2012/0142234 A1 Jun. 7, 2012

(30) Foreign Application Priority Data

Aug. 19, 2009 (DE) ..... 10 2009 038 092

(51) Int. Cl.
*H01R 9/24* (2006.01)

(52) U.S. Cl.
USPC ..... 439/884

(58) Field of Classification Search
USPC ..... 439/83, 367, 271, 519, 821, 884, 439/843
See application file for complete search history.

(56) References Cited

U.S. PATENT DOCUMENTS

| | | | | |
|---|---|---|---|---|
| 2,643,319 | A * | 6/1953 | Der Willigen, V | 219/99 |
| 3,218,606 | A * | 11/1965 | Schultz | 439/844 |
| 3,557,428 | A | 1/1971 | Bonhomme | |
| 3,980,387 | A | 9/1976 | Neidecker | |
| 4,934,965 | A * | 6/1990 | Buddrus et al. | 439/845 |
| 5,147,229 | A | 9/1992 | Nestor | |
| 6,268,079 | B1 * | 7/2001 | Inoue et al. | 429/184 |
| 6,482,049 | B1 * | 11/2002 | Swearingen | 439/843 |
| 6,696,199 | B2 * | 2/2004 | Yoshida et al. | 429/182 |
| 7,143,779 | B2 * | 12/2006 | Parker | 137/375 |
| 2004/0003498 | A1 | 1/2004 | Swearingen et al. | |

FOREIGN PATENT DOCUMENTS

| | | |
|---|---|---|
| DE | 102005062709 | 7/2007 |
| DE | 102006012434 | 9/2007 |
| DE | 102007055040 | 5/2009 |
| WO | WO0070713 | 11/2000 |
| WO | WO0115277 | 3/2001 |

* cited by examiner

*Primary Examiner* — Chandrika Prasad
(74) *Attorney, Agent, or Firm* — Smartpat PLC; Axel Nix

(57) ABSTRACT

The invention relates to a bushing contact element (1) with a receiving chamber (10) for a counter contact, comprising a cylindrical metal contact sleeve (2) and a contact grid (3) arranged in the contact sleeve (2) in the receiving casing (10) for electrically contacting a counter contact, the cylindrical contact sleeve (2) at one of its ends being completely sealed with respect to the receiving chamber (10) by a metal contact cover (4).

13 Claims, 1 Drawing Sheet

FEMALE ELECTRICAL CONTACT SYSTEM WITH A CONTACT SLEEVE WELDED TO A CONTACT COVER

TECHNICAL FIELD

The disclosure relates to a cylindrical female contact element comprising a hyperbolic contact cage.

BACKGROUND

Plug-type connectors with a contact region having a cage-like design and being configured as a cylindrical hyperbolic hollow body are known as RADSOK connectors. The hyperbolic body preferably comprises contact laminations in the longitudinal direction or contact spring arms for making contact with a plug pin.

For reasons of costs, the hyperbolic contact cages are generally shaped as a stamped/bent part from sheet metal and then introduced into a cylindrical tubular sleeve.

Various cylindrical female contact elements are known in the prior art which are likewise stamped from sheet metal, with the cylindrical bush like body being produced by rolling or bending and rolling the stamped metal sheet.

Such a plug-type connection is known from DE 197 34 524 C2, for example. Said document discloses a cylindrical female contact, comprising a contact part and a connection part, the contact part having a cylindrical sheath and the cylindrical sheath having at least one contact spring tongue which is stamped out of the sheath and dips into the receiving region of the cylinder, with the result that a plug pin can make contact with this spring contact element as soon as said plug pin is plugged into the cylindrical female contact.

In the prior art, DE 10 2005 062 709 A1 discloses a contact system which is arranged between a cylindrical heavy duty female contact connector and a planar conductor track element with two opposing flat sides. The cylindrical heavy duty female contact connector is in this case introduced into an opening in a conductor track element and pressed with the planar conductor track element between two contact pressure elements with a corresponding contour. This produces a relatively flat female contact which nevertheless has a female contact element which is open on both sides.

A further plug-type connector system known from the prior art having a cylindrical heavy duty female contact connector is known from DE 10 2007 055 040 A1. In said document, the electrical contact element concerns a cylindrical female contact which is connected to a contact holder in a force fitting and form fitting manner on the outer sheath of the cylindrical female contact by means of thermal shrink fitting.

The previously mentioned contact systems are all configured in such a way that they can be used in technical applications in which there is limited installation space available in respect of the plug in direction of the female contact. In principle, the length of the female contact determines the required contact overlap, and the plug-type connector housing (if provided) determines the overall size of the plug-type connector system.

Plug-type connectors of the generic type as mentioned above are increasingly used in applications in which the climatic environmental conditions place stringent requirements on the plug-type connector system. In particular in the sector of electric drives and hybrid vehicles, heavy duty female contact connectors are used in the engine compartment or at exposed points at which the plug-type connector system is loaded with dirt and liquids.

In this regard, numerous solutions for plug-type connector housings are known from the prior art which firstly perform the function of protection against electric shock and secondly perform a sealing function. In particular in the case of requirements for waterproofness, it is necessary to ensure that no moisture can enter the female connector of the plug-type connector. Secondly, heavy duty female contact connectors are subject to considerable thermal loading when used in the high current range and temperatures of over 150° Celsius may occur.

This results in difficulties as regards the choice of polymers which still perform the sealtightness function of the plug-type connector system to a sufficient extent at such temperatures. Secondly, there is the problem of the dissipation of resultant heat from heat losses in the plug-type connector system. In both problem cases, this results in the solutions known from the prior art being insufficient for sealing the plug-type connector, on the one hand, and for meeting the requirements as regards installation space, on the other hand.

SUMMARY

An object of the present disclosure is to provide a cylindrical heavy duty contact element which is sealed off with respect to the surrounding environment and at the same time able to provide good heat dissipation.

A further object of the present disclosure is to develop a contact system such that the possibility of connecting a cable appropriate for the application is provided at the same time.

Since, in particular in the sector of the automotive industry and in electric motor engineering, the economic conditions under which a plug-type connector system is to be produced is increasingly of considerable importance, it should furthermore be possible for the plug-type connector system to be produced inexpensively and in a very simple manner.

The abovementioned objects are achieved by the features of the independent claim. Preferred embodiments are characterized in the dependent claims.

A cylindrical heavy duty female contact connector is provided, in which a flat contact cover at the same time seals the connector and establishes the electrical connection to a cable. Furthermore, the contact cover serves to dissipate heat away from the contact connector.

The disclosed contact system comprises a cylindrical heavy duty female contact connector. A metal contact cover closes the female element, said contact cover having a connection section for connecting a wire and thereby establishing an electrical connection.

Advantageously, the metal contact cover is connected to the lower end of the cylindrical female contact by a butt weld.

Likewise advantageously, the contact cover is in the form of a substantially rectangular, thin metal sheet. The metal sheet comprises a sealing section and a connection section. The sealing section is formed by virtue of the fact that the butt weld is formed continuous between the cylindrical female contact and the contact cover. This ensures that the contact system, i.e. the cylindrical female contact, is closed in a watertight manner against the contact cover. The weld seam in this case replaces another sealing element which would otherwise be required and in addition dispenses with the need for further housing components.

Advantageously, the weld seam is provided over the outer circumference of the cylindrical female contact.

The following detailed description of the invention is merely exemplary in nature and is not intended to limit the invention or the application and uses of the invention. Furthermore, there is no intention to be bound by any theory presented in the preceding background of the invention or the following detailed description of the invention.

BRIEF DESCRIPTION OF THE DRAWINGS

The invention will be explained in more detail below using the description relating to an exemplary embodiment with reference to the drawings, in which.

DETAILED DESCRIPTION

Figure 1:
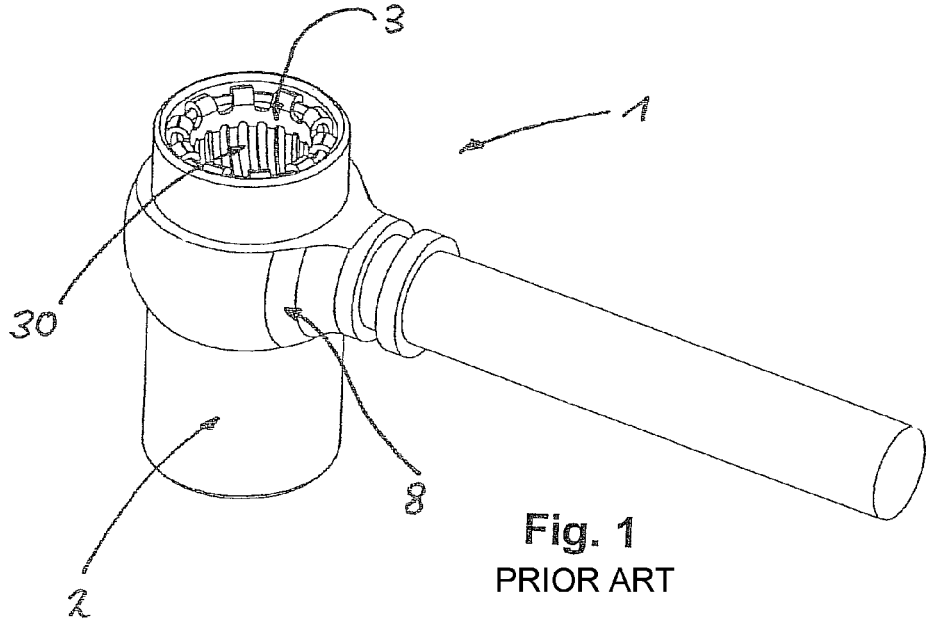
Fig. 1 PRIOR ART
FIG. 1 shows a cylindrical female contact known from the prior art with a hyperbolic contact grating introduced.

FIG. 1 illustrates a known female contact system 1. The female contact system 1 comprises a cylindrical contact sleeve 2 which is made of metal, and into which a hyperbolic contact grating 3 with contact laminations 30 is introduced. A contact holder 8 is provided on the outer surface of the female contact system 1. This female contact system 1 as known from the prior art is open at both ends and is not sealed off against dirt, dust and moisture.

Figure 2:
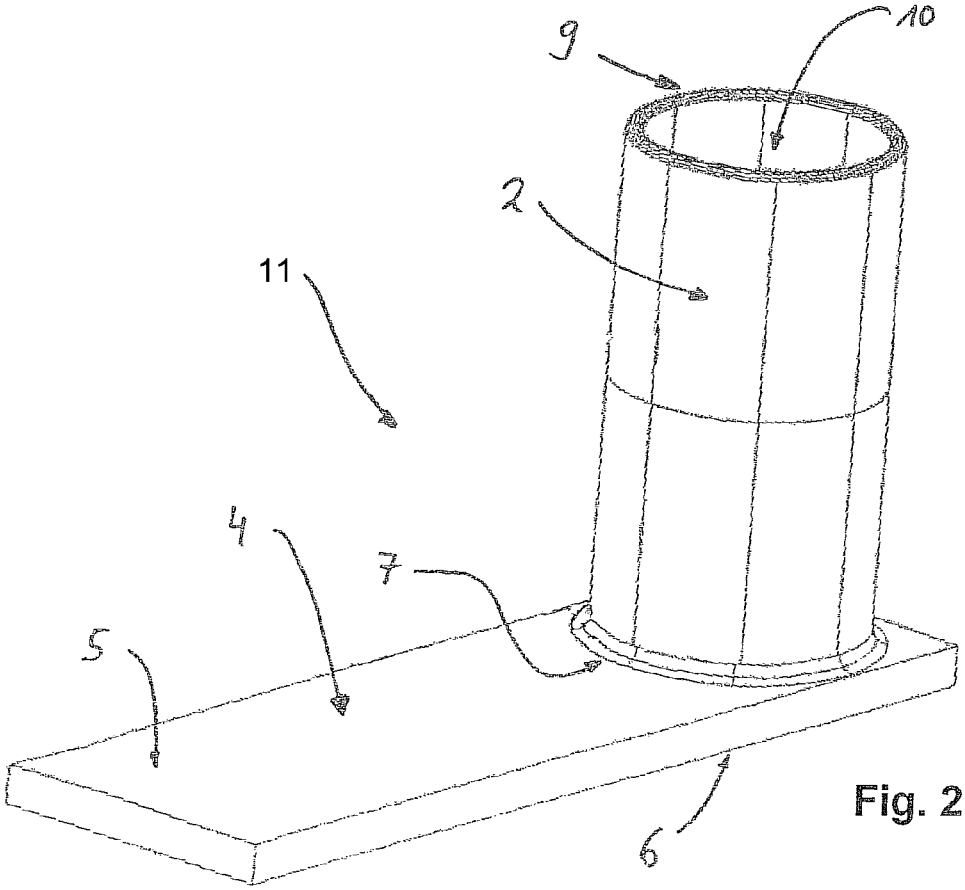
FIG. 2 shows a cylindrical female contact which is welded to a contact cover.

Referring now to FIG. 2, a female contact system 11 comprises a cylindrical contact sleeve 2. A hyperbolic contact grating 3 (not shown in FIG. 2) is introduced into the cylindrical contact sleeve 2. The female contact system 11 is open at its upper end 9 in order to be electrically connected to a mating contact pin. A substantially flat contact cover 4 is located at the lower end of the female contact system 11, i.e. opposite the upper end 9. The contact cover 4 comprises a connection section 5 and a sealing section 6. The sealing section 6 is in direct contact with the lower end of cylindrical contact sleeve 2 and is connected to the contact sleeve 2 by a weld seam 7. Weld seam 7 is arranged continuously at the abutment point between the cylindrical contact sleeve 2 and the contact cover 4. Preferably, the weld seam 7 is in the form of a continuous butt weld and can be welded directly to the contact cover 4, without any change to the contours at the cylindrical contact sleeve 2. At the connection section 5, electrical cables of different geometries and with different cross sections can be welded in freely scalable fashion. It is also possible for a plurality of separate cables to be attached to the connection section 5 of the contact cover 4. Advantageously, the contact cover 4 is produced from a highly conductive metal material, which can furthermore be welded easily.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

DRAWINGS REFERENCE NUMERALS

1 Female contact system
11 Female contact system
2 Cylindrical contact sleeve
3 Hyperbolic contact grating
4 Contact cover
5 Connection section
6 Sealing section
7 Weld seam
8 Contact holder
9 Contact opening
10 Receiving area
30 Contact laminations

The invention claimed is:

1. A female contact system comprising:

a cylindrical contact sleeve having an open upper end and a sealed lower end;

a receiving area formed inside the cylindrical contact sleeve for receiving a mating contact pin, the receiving area being accessible through the open upper end of the cylindrical contact sleeve;

a contact grating disposed within the receiving area of the cylindrical contact sleeve, the contact grating configured to electrically connect the cylindrical contact sleeve to the mating contact pin; and a contact cover arranged to seal the lower end of the cylindrical contact sleeve, wherein the contact cover is connected to the cylindrical contact sleeve by a continuous weld seam extending along a circumference of the lower end of the cylindrical contact sleeve.

2. The female contact system as in claim 1, wherein in the contact cover is a substantially flat metal sheet.

3. The female contact system as in claim 1, wherein the contact cover comprises an electrical connection section and a sealing section.

4. The female contact system as in claim 3, wherein the cylindrical contact sleeve is connected to the contact cover at the sealing section.

5. The female contact system as in claim 4, wherein the weld seam is formed by a butt weld.

6. The female contact system as in claim 1, wherein the contact grating comprises a hyperbolic contact grating with a plurality of contact laminations that are spaced apart in pairs.

7. The female contact system as in claim 1, wherein the seal between the contact cover and the cylindrical contact sleeve is watertight.

8. The female contact system as in claim 1, wherein the cylindrical contact sleeve is made of metal.

9. A female contact system comprising:

a cylindrical metal contact sleeve having an upper end and a lower end;

a receiving area formed inside the cylindrical metal contact sleeve for receiving a mating contact pin, the receiving area being accessible through the upper end of the cylindrical contact sleeve;

a contact grating disposed within the receiving area of the cylindrical contact sleeve, the contact grating configured to electrically connect the cylindrical contact sleeve to the mating contact pin; and a contact cover comprising an electrical connection section and a sealing section, the contact cover being connected at the sealing section to the lower end of the cylindrical metal contact sleeve by a continuous weld seam, wherein the lower end of the cylindrical metal contact sleeve is sealed by the contact cover.

10. The female contact system as in claim 9, wherein in the contact cover is a substantially flat metal sheet.

11. The female contact system as in claim 9, wherein the weld seam is formed by a butt weld.

12. The female contact system as in claim 9, wherein the contact grating comprises a hyperbolic contact grating with a plurality of contact laminations that are spaced apart in pairs.

13. The female contact system as in claim 9, wherein the seal between the contact cover and the cylindrical contact sleeve is watertight.

* * * * *